US008584322B2

(12) United States Patent
Nakasone

(10) Patent No.: US 8,584,322 B2
(45) Date of Patent: Nov. 19, 2013

(54) HINGE DEVICE

(75) Inventor: Hisashi Nakasone, Kanagawa (JP)

(73) Assignee: Piolax Inc., Yokohama-shi, Kanagawa (JP)

( * ) Notice: Subject to any disclaimer, the term of this patent is extended or adjusted under 35 U.S.C. 154(b) by 0 days.

(21) Appl. No.: 13/067,646

(22) Filed: Jun. 16, 2011

(65) Prior Publication Data

US 2011/0308043 A1 Dec. 22, 2011

(30) Foreign Application Priority Data

Jun. 18, 2010 (JP) ..... P. 2010-139759

(51) Int. Cl.
*E05D 5/12* (2006.01)

(52) U.S. Cl.
USPC ..... 16/380; 16/386

(58) Field of Classification Search
USPC ..... 16/380, 381, 386, 254, 262, 225, 231, 16/232, 50; 296/37.8
See application file for complete search history.

(56) References Cited

U.S. PATENT DOCUMENTS 4,934,750 A * 6/1990 Eichler et al. ..... 296/37.8
5,067,625 A * 11/1991 Numata ..... 220/827
5,144,720 A * 9/1992 Aihara et al. ..... 16/232
5,441,167 A * 8/1995 Shigeru ..... 220/830
6,832,710 B2 * 12/2004 Galbraith et al. ..... 224/413
7,770,953 B2 * 8/2010 Koarai ..... 296/24.34
2009/0106938 A1 * 4/2009 Mori ..... 16/277
2010/0050380 A1 * 3/2010 Fujiwara et al. ..... 16/242
2012/0102677 A1 * 5/2012 Koarai et al. ..... 16/337

FOREIGN PATENT DOCUMENTS

JP 06-010941 A 1/1994
WO WO 2012063688 A1 * 5/2012

* cited by examiner

*Primary Examiner* — William Miller
(74) *Attorney, Agent, or Firm* — McGinn IP Law Group, PLLC

(57) ABSTRACT

According to an aspect of the present invention, a hinge device includes: a shaft part having a protruding part; and a bearing part having an insert hole into which the protruding part is inserted. A first plane part is formed on an outer peripheral surface of the protruding part so as to extend in an axial direction thereof. A second plane part is formed on an inner peripheral surface of the insert hole so as to extend in an axial direction thereof. A diameter of a circumscribed circle defined on an sectional outer periphery of the protruding part in the axial direction thereof is larger than a diameter of an inscribed circle defined on a sectional inner periphery of the insert hole in the axial direction thereof. And, at least one of the protruding part and the insert hole has an elasticity.

4 Claims, 9 Drawing Sheets

10

HINGE DEVICE

CROSS-REFERENCE TO RELATED APPLICATION(S)

This application claims priorities from Japanese Patent Application No. 2010-139759 filed on Jun. 18, 2010, the entire contents of which are incorporated herein by reference.

FIELD

The present invention relates to a hinge device including a shaft part and a bearing part.

BACKGROUND

To a lid of a console box of a vehicle, a hinge device for connecting the lid to an accommodation box is attached. For example, JP-H06-010941-A discloses a hinge device having a shaft part and a bearing part which are integrally molded with plastic. The shaft part has plural recesses, and the bearing part has plural projections corresponding to the recesses.

In JP-H06-010941-A, a so-called click feeling is given to the user when the projections of the bearing part are fitted to the recesses of the shaft part. However, when the projections are abraded as a result of long period of use, the click feeling is loosen. Further, since the diameter of the bearing part is larger than the diameter of the shaft part, the shaft part is supported only by the ends of the projections. Accordingly, a sliding resistance of the bearing part and the shaft part is poor.

SUMMARY

One object of the present invention to provide a hinge device which can stably give a sufficient click feeling for a long period of time and increases a frictional force between a shaft part and a bearing part during a relative rotation of the shaft part and the bearing part.

According to an aspect of the present invention, there is provided a hinge device including: a shaft part having a protruding part; and a bearing part having an insert hole into which the protruding part is inserted, wherein a first plane part is formed on an outer peripheral surface of the protruding part so as to extend in an axial direction thereof, wherein a second plane part is formed on an inner peripheral surface of the insert hole so as to extend in an axial direction thereof, wherein a diameter of a circumscribed circle defined on an sectional outer periphery of the protruding part in the axial direction thereof is larger than a diameter of an inscribed circle defined on a sectional inner periphery of the insert hole in the axial direction thereof, and wherein at least one of the protruding part and the insert hole has an elasticity.

According to the above configuration, when the first plane part is engaged with the second plane part during the relative rotation of the protruding part and the insert hole, a click feeling can be given to the user. Further, an aging deformation of a shape is hardly generated in the first plane part and the second plane part. Further, since at least one of the protruding part and the insert hole has the elasticity, the diameter of the sectional circumscribed circle of the protruding part in the axial direction can be reasonably made larger than the diameter of the sectional inscribed circle of the insert hole in the axial direction, thereby improving the click feeling.

According to the present invention, the satisfactory click feeling can be stably obtained for a long period of time and a frictional force can be improved between the shaft part and the bearing part during the relative rotation of those two parts.

DETAILED DESCRIPTION

Figure 1:
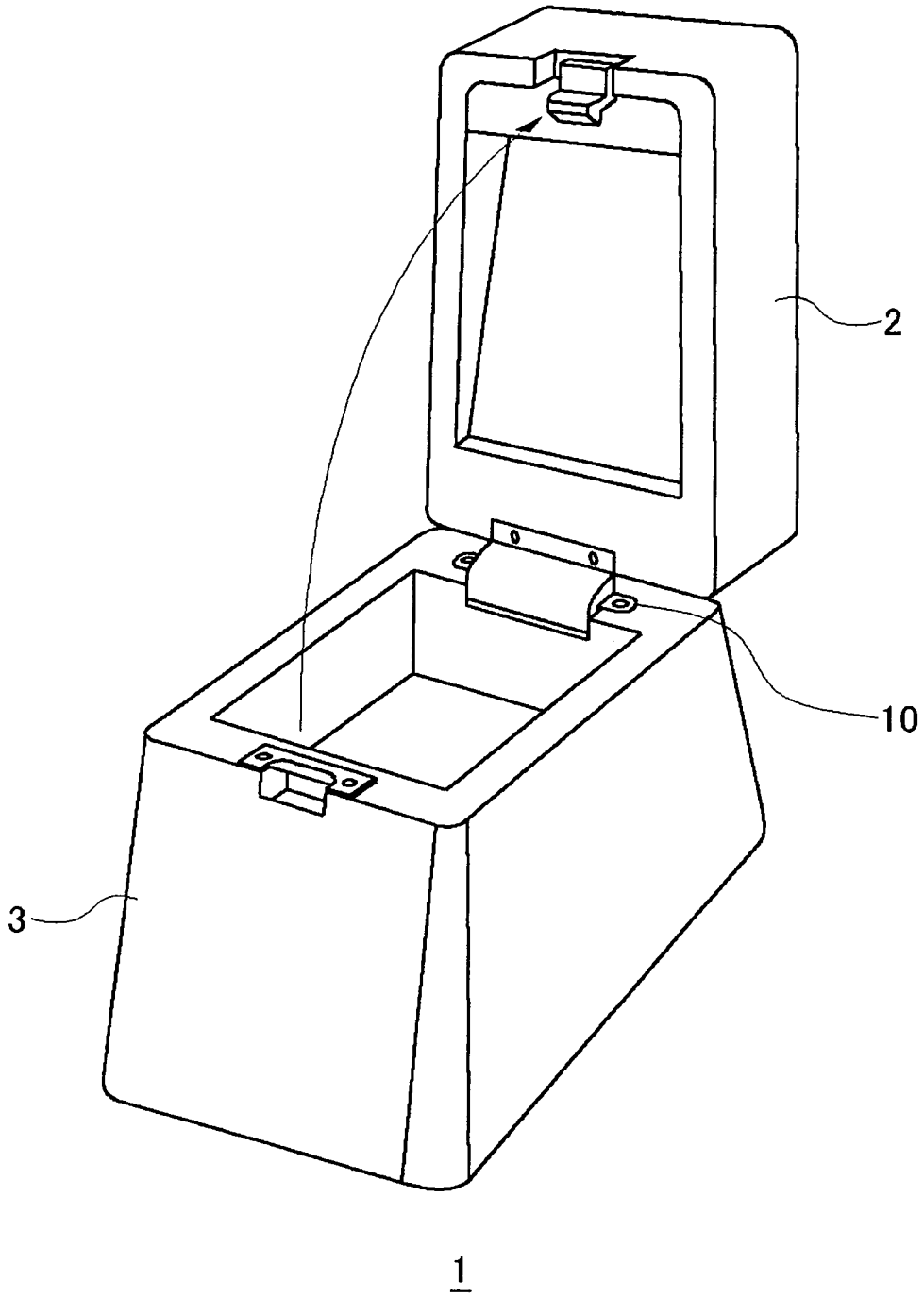
FIG. 1 illustrates a console box according to an embodiment.

Embodiments will be described below by referring to the drawings. The same or equivalent components or members respectively shown in the drawings are designated by the same reference numerals and a duplicated explanation will be omitted. Dimensions of the members in the drawings are respectively enlarged or reduced for facilitating the understanding.

FIG. 1 illustrates a console box 1 according to an embodiment. For example, the console box 1 is arranged in a vehicle at a position between a driver's seat and a passenger's seat. The console box 1 includes a lid 2, an accommodation box 3 and a hinge device 10. The lid 2 is self-supported when the lid is completely opened. The hinge device 10 rotatably connects the lid 2 to the accommodation box 3.

Figure 2:
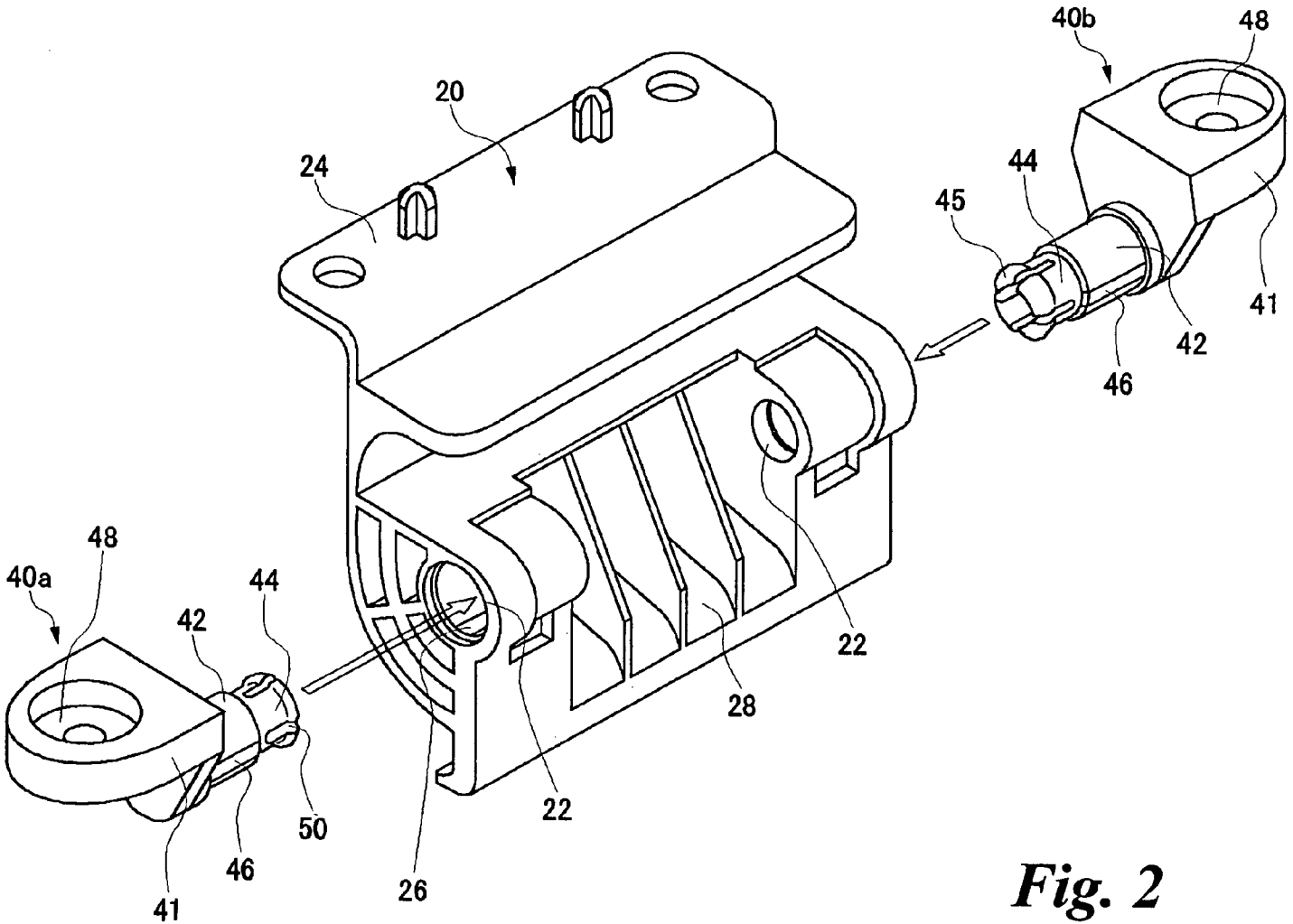
FIG. 2 illustrates a hinge device according to the embodiment.

FIG. 2 illustrates the hinge device 10 according to the embodiment. The hinge device 10 includes a bearing part 20, a first shaft part 40*a* and a second shaft part 40*b* (also, referred to as a "shaft part 40", collectively).

The first shaft part 40*a* and the second shaft part 40*b* may be formed in the same shapes so that each shaft part is commonly used as the right part or the left part. Each shaft part 40 has a base part 41 and a cylindrical-shaped protruding part 42 that protrudes from the base part 41. The shaft part 40 is fixed to the accommodation box 3 by inserting a pin into a fixing part 48 formed in the base part 41. On an outer peripheral surface of the protruding part 42, a first plane part 46 is formed to extend in the axial direction. In an end of the protruding part 42, a leg part 44 is provided to extend in the axial direction. A diameter of the leg part 44 is smaller than the diameter of the protruding part 42. Four slits 50 are formed in the leg part 44 to thereby divide the leg part 44 into four. In an end of the leg part 44, a flange part 45 is formed. The flange part 45 has a diameter larger than that of the leg part 44.

The bearing part 20 includes insert holes 22 in the right and left sides of a bearing main body part 28. Into each of the insert holes 22, the leg part 44 and the protruding part 42 of the shaft part 40 are inserted. Thus, the bearing part 20 is supported by the shaft parts 40. The bearing main body part 28 is formed to have a sector cross-sectional shape in a direction perpendicular to the axial direction. A lid connecting part 24 of the bearing part 20 is connected to the lid 2 of the console box 1 so as to integrally rotate with the lid 2. In an inner peripheral surface of the insert hole 22, a second plane part 26 is formed to extend in the axial direction. The position and shape of the second plane part 26 are set correspondingly with the first plane part 46. For example, in the insert hole 22 and the protruding part 42, the two second plane parts 26 and the two first plane parts 46 having the same width and the same depth are respectively formed such that the two plane parts are axisymmetric with respect to the axial direction.

Figure 3A:
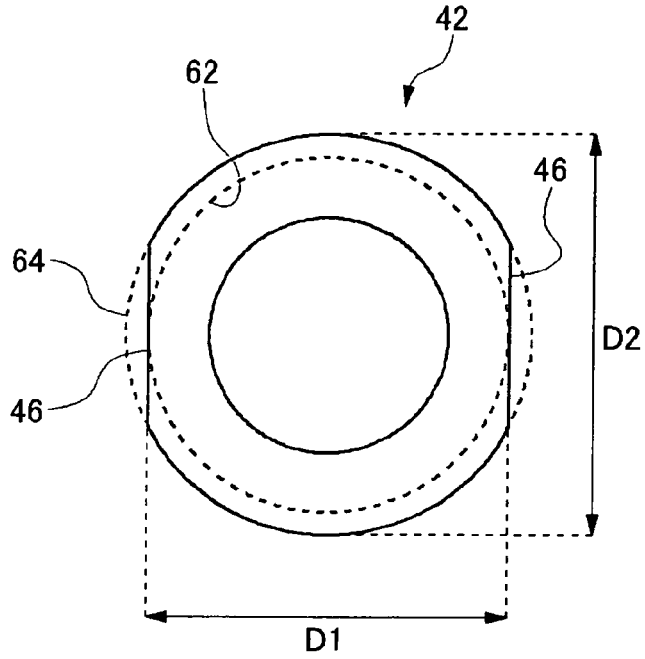
FIGS. 3A and 3B sectionally illustrate a protruding part and an insert hole according to the embodiment.
Figure 3B:
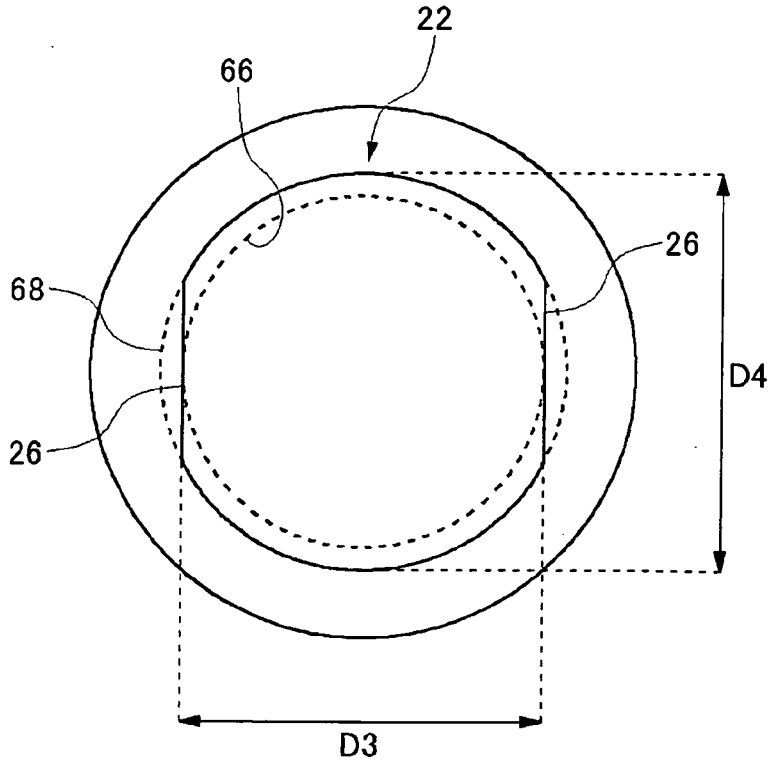

FIGS. 3A and 3B sectionally illustrate the protruding part 42 and the insert hole 22 according to the embodiment. FIG. 3A shows a sectional view orthogonal to the axial direction of the protruding part 42 and FIG. 3B shows a sectional view orthogonal to the axial direction of the insert hole 22.

As shown in FIG. 3A, the two first plane parts 46 are formed on an outer periphery of the protruding part 42 so as to be opposed from each other. The number of the first plane parts 46 is not limited to two and may be set to one or three or more, for example. The protruding part 42 is formed into a hollow shape in which the axis portion is removed. Thus, the protruding part 42 has elasticity. In this embodiment, the elasticity is provided to the protruding part 42 by forming the protruding part 42 into the hollow shape. In this case, an elastic deformation of the protruding part 42 can be suppressed. Slits may be formed to provide the elasticity to the protruding part 42. As shown in FIG. 3A, an inscribed circle 62 and a circumscribed circle 64 are defined so as to respectively be in contact with the outer periphery of the protruding part 42 in the section. The inscribed circle 62 has a diameter D1, and the circumscribed circle 64 has a diameter D2.

As shown in FIG. 3B, two second plane parts 26 are formed on an inner periphery of the insert hole 22 so as to be opposed from each other. The second plane part 26 has the number, position and shape corresponding to those of the first plane part 46. As shown in FIG. 3B, an inscribed circle 66 and a circumscribed circle 68 are defined so as to respectively be in contact with the inner periphery of the insert hole 22 in the section. The inscribed circle 66 has a diameter D3, and the circumscribed circle 68 has a diameter D4.

Figure 4A:
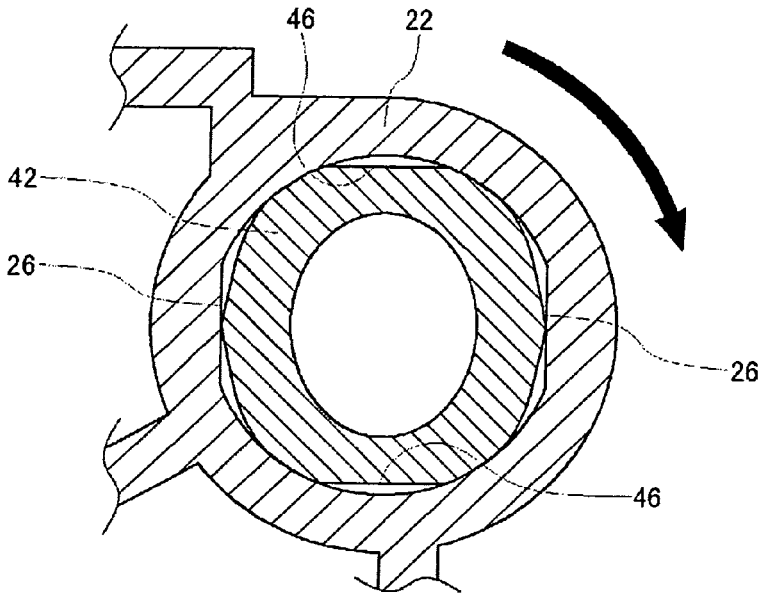
FIGS. 4A and 4B sectionally illustrate states that the protruding part is inserted into the insert hole.
Figure 4B:
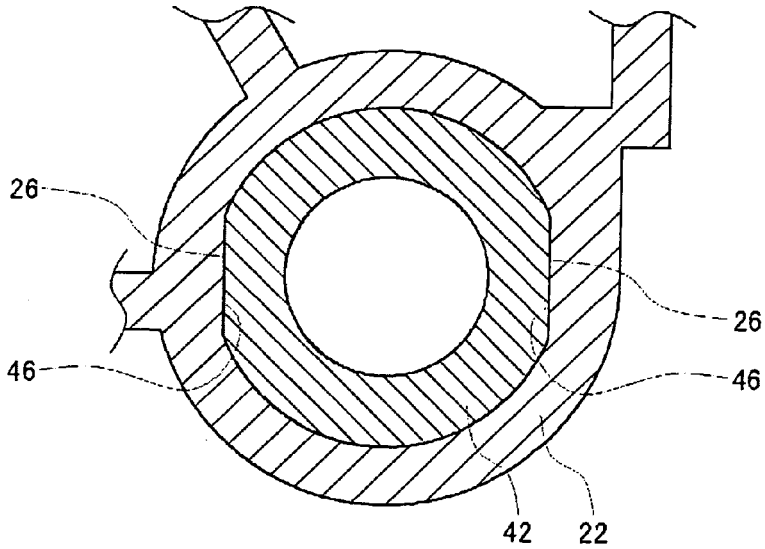

FIGS. 4A and 4B sectionally illustrate a state where the protruding part 42 is inserted into the insert hole 22. FIG. 4A shows the relation of rotating positions of the insert hole 22 and the protruding part 42 when the lid 2 begins to be opened. FIG. 4B shows the relation of the rotating positions of the insert hole 22 and the protruding part 42 when the lid 2 is completely opened. The lid 2 is rotated by about 90° from a horizontal state where the lid 2 is closed to a vertical state where the lid 2 is completely opened to stand upright.

During the rotation, a state where the first plane part 46 is not engaged with the second plane part 26 as shown in FIG. 4A is referred to as a first state, and a state where the first plane part 46 is engaged with the second plane part 26 as shown in FIG. 4B is referred to as a second state. The state where the first plane part 46 is engaged with the second plane part 26 means a state where their planes come into tight planar contact with each other. The state where the first plane part 46 is not engaged with the second plane part 26 means a state where their planes do not come into such planar contact. In FIG. 4A, a curved surface of the shaft part 40 comes into a linear contact with the second plane part 26 of the bearing part 20. However, the present invention is not limited thereto. For example, the surface of the shaft part 40 may be formed to come into planar contact with the second plane part 26 of the bearing part 20 in the first state.

In the hinge device 10 according to the embodiment, the diameter D2 of the circumscribed circle 64 defined on the sectional outer periphery of the protruding part 42 is set larger than the diameter D3 of the inscribed circle 66 defined on the sectional inner periphery of the insert hole 22. Thus, in the first state shown in FIG. 4A, a part of the protruding part 42 other than the first plane part 46 is allowed to come into contact with the second plane part 26 of the insert hole 22 so that a frictional force between the insert hole 22 and the protruding part 42 is increased. Thus, even in the first sate that the lid 2 is half opened, the lid 2 can be rested relative to the accommodation box 3 against the gravity.

The diameter D2 is set larger than the diameter D3 by a certain value or more. The certain value may be set based on a production error to reduce a possibility that the diameter D2 is smaller than the diameter D3 due to the production error.

When the sliding resistance of the insert hole 22 and the protruding part 42 is high in the second state, even if an acceleration is applied to the standing lid 2 during driving a vehicle, the lid 2 is maintained in a stationary state. In the second state shown in FIG. 4B, the first plane part 46 of the protruding part 42 is engaged with the second plane part 26 of the insert hole 22. Thus, the diameter D1 of the inscribed circle defined on the sectional outer periphery of the protruding part 42 is set larger than the diameter D3 of the inscribed circle 66 defined on the sectional inner periphery of the insert hole 22 by the certain value or more. Thus, when the acceleration is applied to the completely opened lid 2, a possibility that the lid 2 is closed can be reduced.

The diameter D2 of the circumscribed circle 64 defined on the sectional outer periphery of the protruding part 42 is formed to be substantially the same as the diameter D4 of the circumscribed circle 68 defined on the sectional inner periphery of the insert hole 22. Thus, the lid 2 in the completely-opened state can be restrained from shaking.

Figure 5:
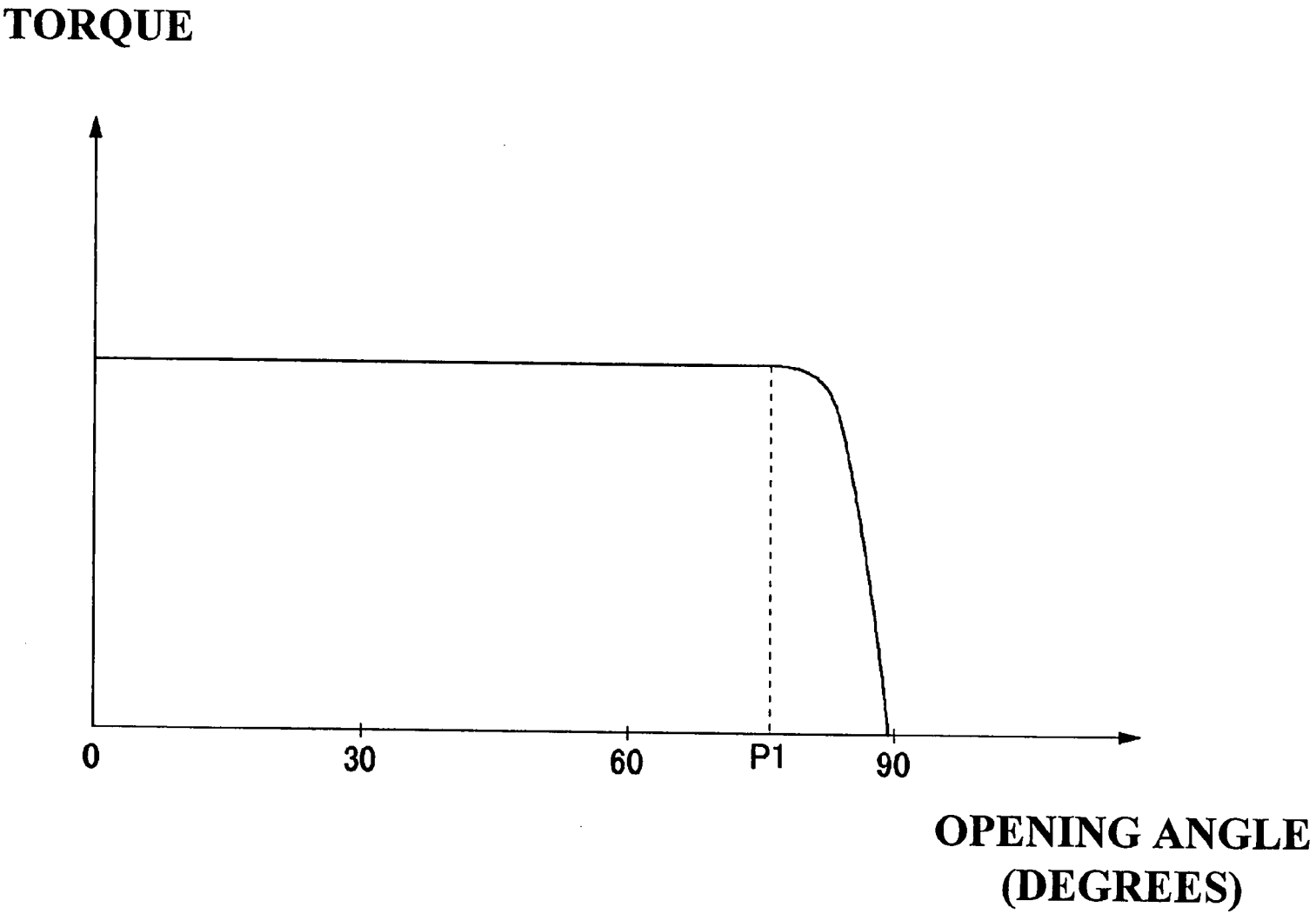
FIG. 5 illustrates a relation between a torque generated due to a friction of the insert hole and the protruding part and an opening angle of a lid.

FIG. 5 shows a relation between a torque necessary for opening the lid and an opening angle of the lid 2. A vertical axis shows the torque, and a horizontal axis shows the opening angle. The opening angle of 0° corresponds to a closed state of the lid 2, while the opening angle of 90° corresponds to a completely-opened state of the lid 2.

When the opening angle is 0°, as shown in FIG. 4A, the relation of the rotating positions of the insert hole 22 and the protruding part 42 is located in the first state, and an outer peripheral part of the protruding part 42 having the diameter D2 comes into contact with an inner peripheral part of the insert hole 22 having the diameter D3. Thus, the sliding resistance is generated in accordance with the rotation of the protruding part 42.

After the lid 2 is opened to the opening angle of P1 where an end part of the second plane part 26 of the insert hole 22 reaches an end part of the first plane part 46 of the protruding part 42, the sliding resistance against the rotation of the protruding part 42 is decreased. And, when the lid 2 is opened to the opening angle of 90° and stopped, the sliding resistance against the rotation of the protruding part 42 is minimized. Due to the inclination/difference of the sliding resistance against the rotation of the protruding part 42, a click feeling is given in a range from the opening angle of P1 to 90°.

In the embodiment, the click feeling can be generated by providing the first plane part 46 of the protruding part 42 and the second plane part 26 of the insert hole 22. The protruding part 42 having such first plane part 46 can be produced with more simple process and lower cost as compared with a case where a recess is formed in the protruding part 42.

In the first plane part 46 and the second plane part 26, the deformation of plane shapes hardly occurs. Thus, the click feeling is obtained for a long period of time. Since an obstacle is not provided in the protruding part 42, it is possible to easily insert the protruding part 42 into the insert hole 22, thereby facilitating an attachment.

Figure 6:
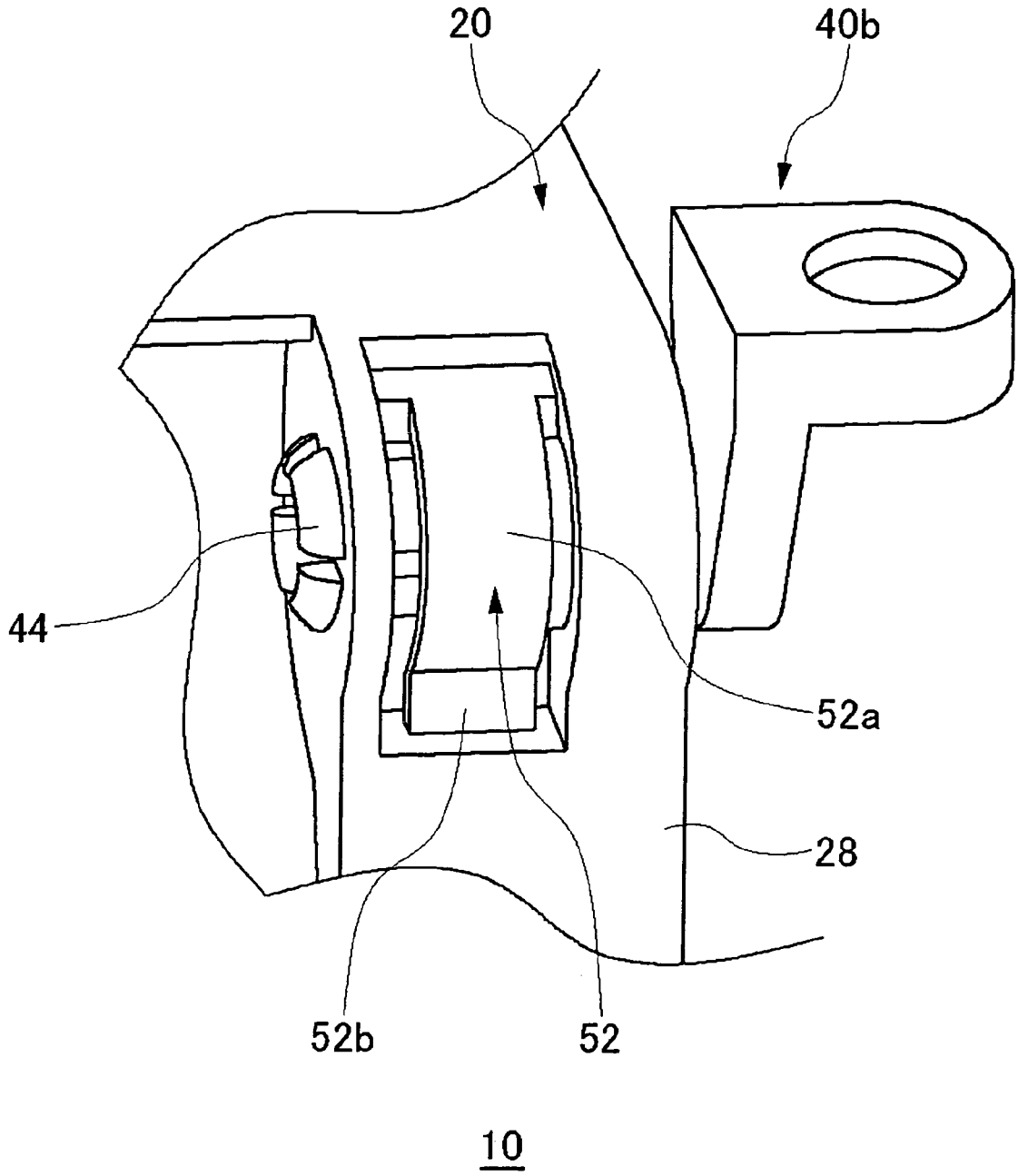
FIG. 6 partially illustrates a hinge device according to a first variation of the embodiment.

FIG. 6 illustrates the hinge device 10 according to a first variation of the embodiment. On an outer side surface of a bearing main body part 28 where an insert hole 22 is provided, a pressing part 52 is provided to press a protruding part 42 inserted into the insert hole 22. The pressing part 52 is formed in a belt shape through a pair of slits. The pressing part 52 has elasticity for pressing the protruding part 42 to the insert hole 22. The pressing part 52 includes a circular arc part 52*a* and a liner part 52*b*. One end of the circular arc part 52*a* is connected to the bearing main body part 28 and the other end is connected to the liner part 52*b*. An inner peripheral surface of the circular arc part 52*a* comes into contact with an outer peripheral surface of the protruding part 42. The liner part 52*b* projects outward from the bearing main body part 28 and is connected to the circular arc part 52*a*. By providing the pressing part 52, the protruding part 42 can be elastically supported.

Figure 7A:
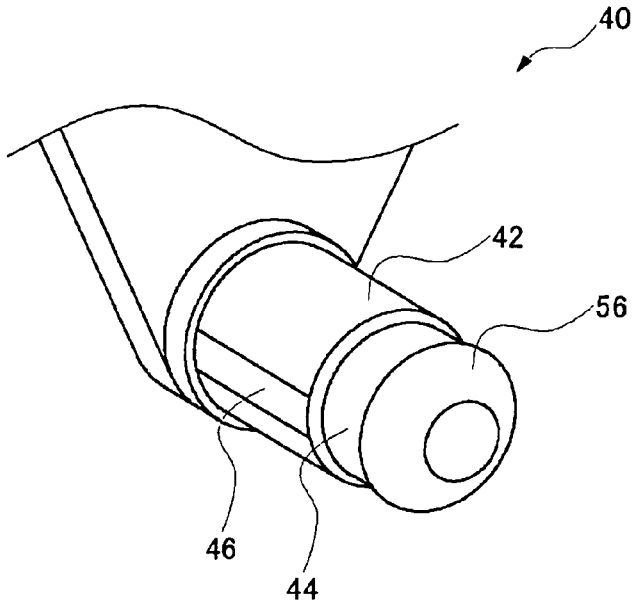
FIGS. 7A and 7B partially illustrate a hinge device according to a second variation of the embodiment.
Figure 7B:
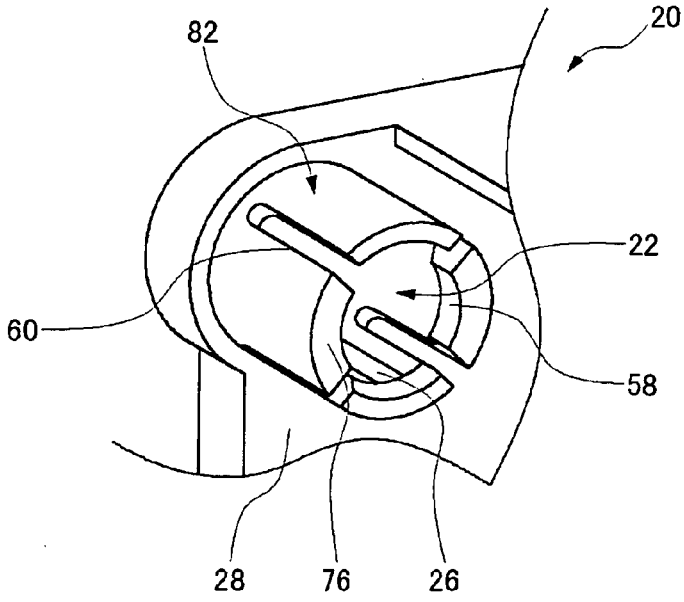

FIGS. 7A and 7B illustrate the hinge device 10 according to a second variation of the embodiment. FIG. 7A shows a part of a shaft part 40 and FIG. 7B shows a part of a bearing part 20. In the shaft part 40, a leg part 44 extends from an end of a protruding part 42 in the axial direction, and a flange part 56 is provided at an end of the leg part 44 to have a diameter larger than that of the leg part 44. The diameter of the leg part 44 is smaller than that of the protruding part 42.

In the bearing part 20, a cylindrical insert hole 82 is provided so as to protrude in the axial direction. One opening end part 76 of the insert hole 82 is not connected to a bearing main body part 28. The insert hole 82 includes four slits 60 extending in the axial direction such that end parts thereof are opened. The insert hole 82 can elastically support the protruding part 42 due to the slits 60. In an inner periphery of the opening end part 76 of the insert hole 82, a small diameter part 58 is provided.

When the protruding part 42 is inserted into the insert hole 82, the small diameter part 58 is fitted to the leg part 44, and the flange part 56 protrudes from the opening end part 76 of the insert hole 82 so as to be caught by the opening end part 76. The flange part 56 functions as a stopper for preventing the shaft part from slipping out after the shaft part 40 is inserted into the insert hole 82.

Figure 8A:
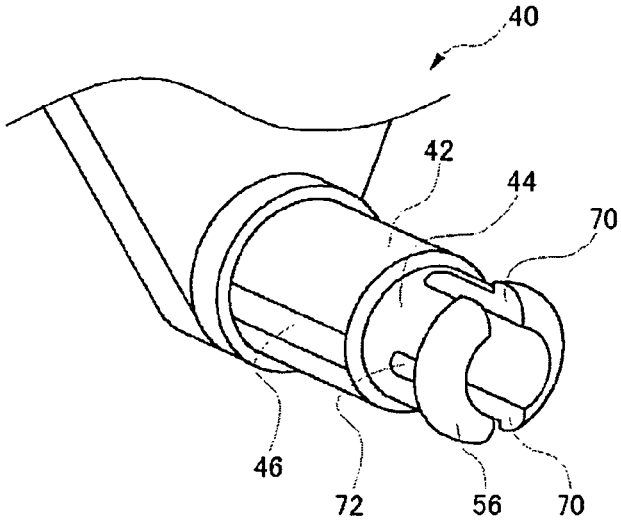
FIGS. 8A to 8C partially illustrate a hinge device according to a third variation of the embodiment.
Figure 8B:
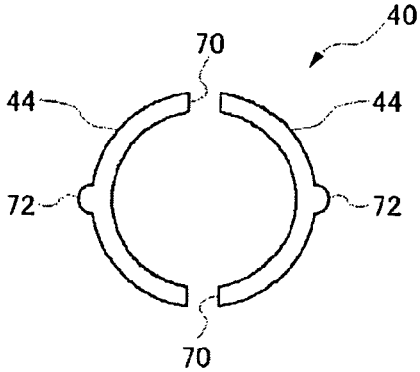
Figure 8C:
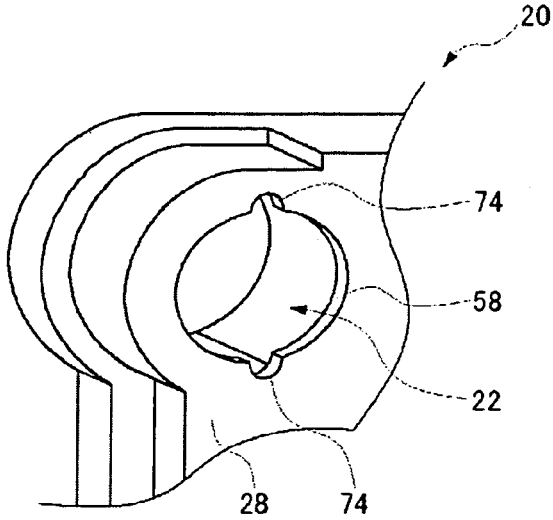
Figure 9A:
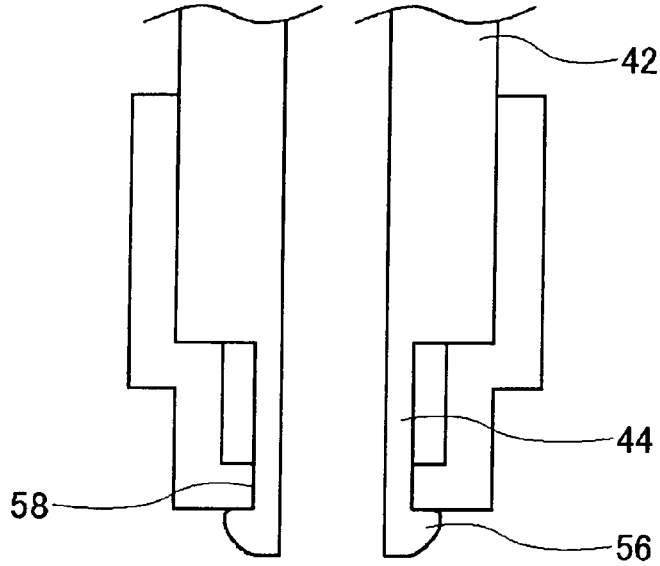
FIGS. 9A and 9B sectionally illustrate states during an inserting operation of a shaft part and a bearing part shown in FIGS. 8A to 8C.
Figure 9B:
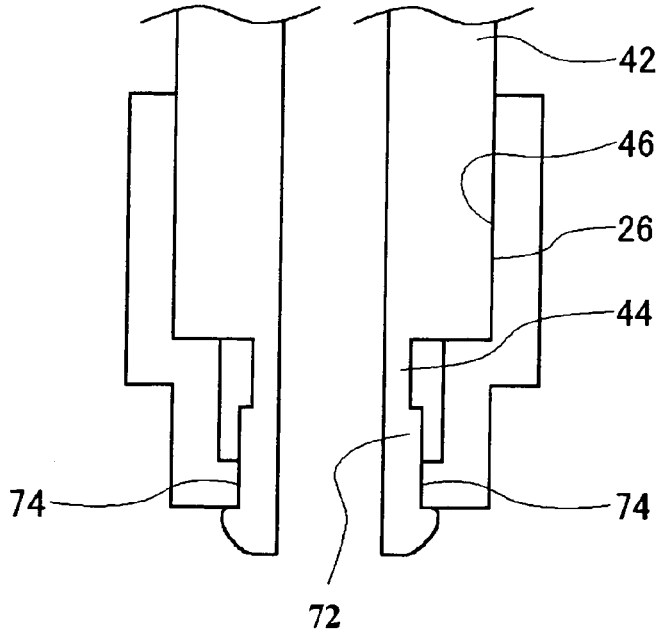

FIGS. 8A to 8C illustrate the hinge device 10 according to a third variation of the embodiment. FIG. 8A illustrates a shaft part 40. FIG. 8B sectionally illustrates a leg part 44 in the shaft part 40. FIG. 8C illustrates a bearing part 20. And, FIGS. 9A and 9B sectionally illustrate the shaft part 40 and the bearing part 20 shown in FIGS. 8A to 8C along the axial direction during an insertion. FIG. 9A shows a part where a projection 72 and a recess 74 are not provided. FIG. 9B shows a part where the projection 72 and the recess 74 are provided. In the shaft part 40, the leg part 44 extends from an end of a protruding part 42 in the axial direction, and a flange part 56 is provided at an end of the leg part 44 to have a diameter larger than that of the leg part 44.

Two slits 70 are provided in the leg part 44, to be opposed and opened at their ends. The slits 70 give elasticity for bending the leg part 44 in a diametrical direction. The diameter of the flange part 56 is reduced due to the elasticity during the insertion of the shaft part 40 and engaged and attached to a small diameter part 58, so that the shaft part 40 can be simply attached to the bearing part 20. As shown in FIG. 9A, the small diameter part 58 inside an insert hole 22 functions as an engagement/attachment part to which the flange part 56 is engaged and attached. When the shaft part 40 is inserted into the insert hole 22, an outer peripheral surface of the leg part 44 comes into contact with an inner peripheral surface of the small diameter part 58.

As shown in FIG. 8B, in the leg part 44, the two projections 72 are formed to protrude in the diametrical direction. As shown in FIG. 8A and FIG. 9B, the projections 72 may be provided at the same positions as those of first plane parts 46 in the circumferential direction. In accordance with the projections 72, the two recesses 74 are formed in the small diameter part 58 of the bearing part 20. While a protruding part 42 is inserted into the insert hole 22 and relatively rotated such that the first plane parts 46 are engaged with second plane parts 26, also the projections 72 are set to be fitted to the recesses 74 at the same time. As a result, the click feeling can be further improved.

The present invention is not limited to the above-described embodiments, and the embodiment may be variously modified in accordance with the knowledge of a skilled person. Such modified embodiments will also fall within the scope of the present invention.

The invention claimed is:

1. A hinge device comprising:

a shaft part having a protruding part; and a bearing part having an insert hole into which the protruding part is inserted, wherein a first plane part is formed on an outer peripheral surface of the protruding part so as to extend in an axial direction thereof, wherein a second plane part is formed on an inner peripheral surface of the insert hole so as to extend in an axial direction thereof, wherein a diameter of a circumscribed circle defined on the outer peripheral surface of the protruding part is larger than a diameter of an inscribed circle defined on the inner peripheral surface of the insert hole at the second plane part, and wherein at least one of the protruding part and the insert hole has an elasticity.

2. The hinge device of claim 1, wherein a diameter of an inscribed circle defined on the outer peripheral surface of the protruding part at the first plane part is equal to or larger than the diameter of the inscribed circle defined on the inner peripheral surface of the insert hole at the second plane part.

3. The hinge device of claim 1, wherein the protruding part is formed into a hollow shape thereby providing the elasticity.

4. The hinge device of claim 1, wherein the shaft part includes:

a leg part extending from an end of the protruding part in the axial direction; and a flange part provided at an end of the leg part to have a diameter larger than a diameter of the leg part, wherein an engagement/attachment part which is engaged with the flange part is provided inside the insert hole, and wherein a projection which diametrically projects is formed in the leg part, while a recess corresponding to the projection is formed in the engagement/attachment part.

* * * * *